US012109475B2

(12) United States Patent
Wolf

(10) Patent No.: US 12,109,475 B2
(45) Date of Patent: Oct. 8, 2024

(54) GOLF TRAINING AID

(71) Applicant: Tour Aim Golf LLC, Carlsbad, CA (US)

(72) Inventor: Noah Wolf, Carlsbad, CA (US)

(73) Assignee: Tour Aim Golf LLC, Carlsbad, CA (US)

( * ) Notice: Subject to any disclaimer, the term of this patent is extended or adjusted under 35 U.S.C. 154(b) by 0 days.

(21) Appl. No.: 17/486,303

(22) Filed: Sep. 27, 2021

(65) Prior Publication Data

US 2022/0331679 A1 Oct. 20, 2022

Related U.S. Application Data

(63) Continuation of application No. 29/806,833, filed on Sep. 7, 2021, now Pat. No. Des. 1,007,629.

(60) Provisional application No. 63/177,337, filed on Apr. 20, 2021.

(51) Int. Cl.
*A63B 69/36* (2006.01)
*A63B 71/00* (2006.01)

(52) U.S. Cl.
CPC ..... *A63B 69/3667* (2013.01); *A63B 69/3621* (2020.08); *A63B 71/0036* (2013.01); *A63B 2214/00* (2020.08); *A63B 2225/09* (2013.01)

(58) Field of Classification Search
CPC ..... A63B 69/3667; A63B 69/3621; A63B 71/0036; A63B 2214/00; A63B 2225/09; A63B 71/0045; A63B 69/3623; A63B 69/3676; A63B 2071/0694
USPC ..... 473/257, 218, 261–273
See application file for complete search history.

(56) References Cited

U.S. PATENT DOCUMENTS

| | | | | |
|---|---|---|---|---|
| 5,209,484 | A * | 5/1993 | Randall | A63B 69/36211 473/265 |
| 6,540,620 | B1 * | 4/2003 | Consiglio | A63B 24/0021 473/150 |
| 7,744,479 | B2 * | 6/2010 | Whitfield | G07F 17/32 473/150 |
| 11,458,379 | B1 * | 10/2022 | Leskiff | A63B 69/3621 |
| 2005/0282651 | A1 * | 12/2005 | Pierce | A63B 69/3676 473/261 |
| 2007/0249429 | A1 * | 10/2007 | Kawashima | A63B 69/3621 473/265 |
| 2013/0178302 | A1 * | 7/2013 | Shahi | A63B 69/3667 473/409 |
| 2014/0148263 | A1 * | 5/2014 | Litton | A63B 69/3676 473/268 |
| 2015/0038248 | A1 * | 2/2015 | Deacon | A63B 69/3621 473/220 |
| 2017/0036092 | A1 * | 2/2017 | Aines | A63B 69/3682 |
| 2019/0001208 | A1 * | 1/2019 | Plantz | A63B 69/3621 |

* cited by examiner

*Primary Examiner* — Nini F Legesse
(74) *Attorney, Agent, or Firm* — Lee & Hayes, P.C.

(57) ABSTRACT

A golf training aid is disclosed for use with alignment sticks. The golf training aid includes an elongate member with a longitudinal axis and a first and second set of holes. The first set of holes is space apart farther than the second set. The elongate ember also has a target alignment hole positioned in between the first and second set of holes. All the holes are constructed to receive and hold an alignment stick. The golf training aid has least two configurations: a wide hitting box configuration and a narrow box configuration.

16 Claims, 15 Drawing Sheets

Wide Hitting Box Configuration

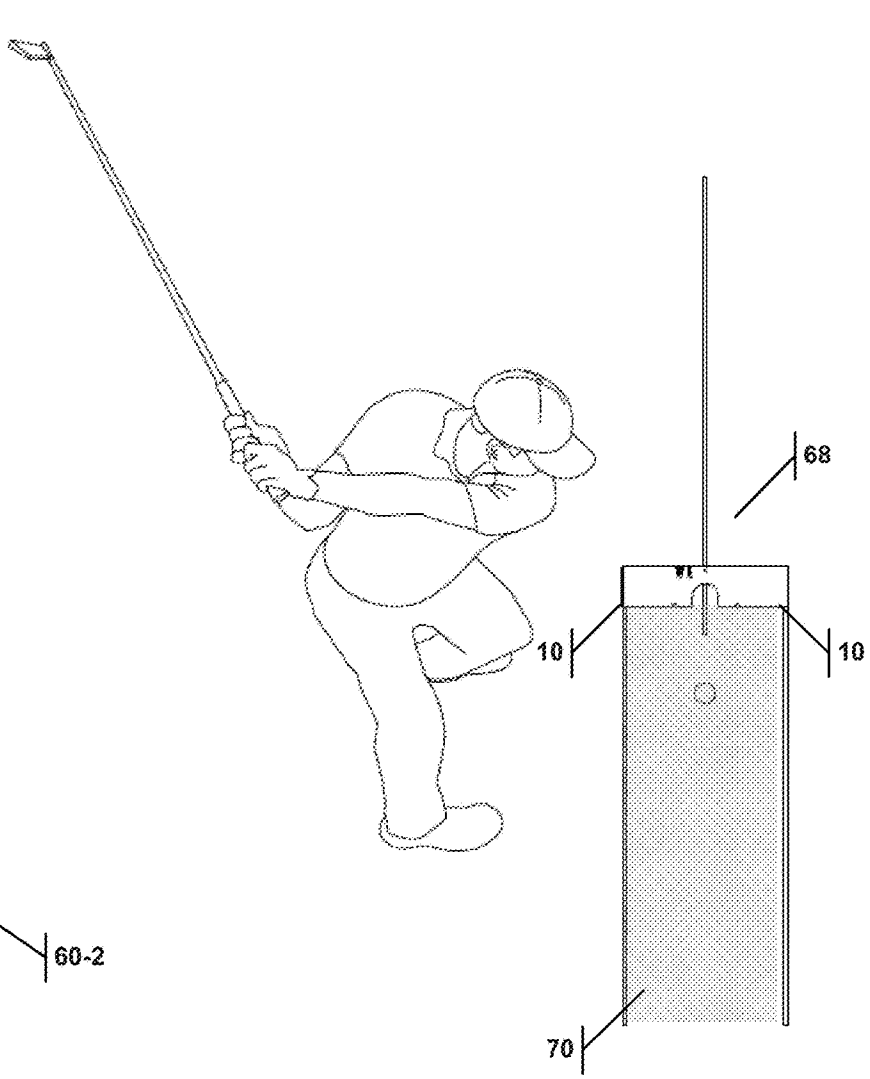
FIG.12B
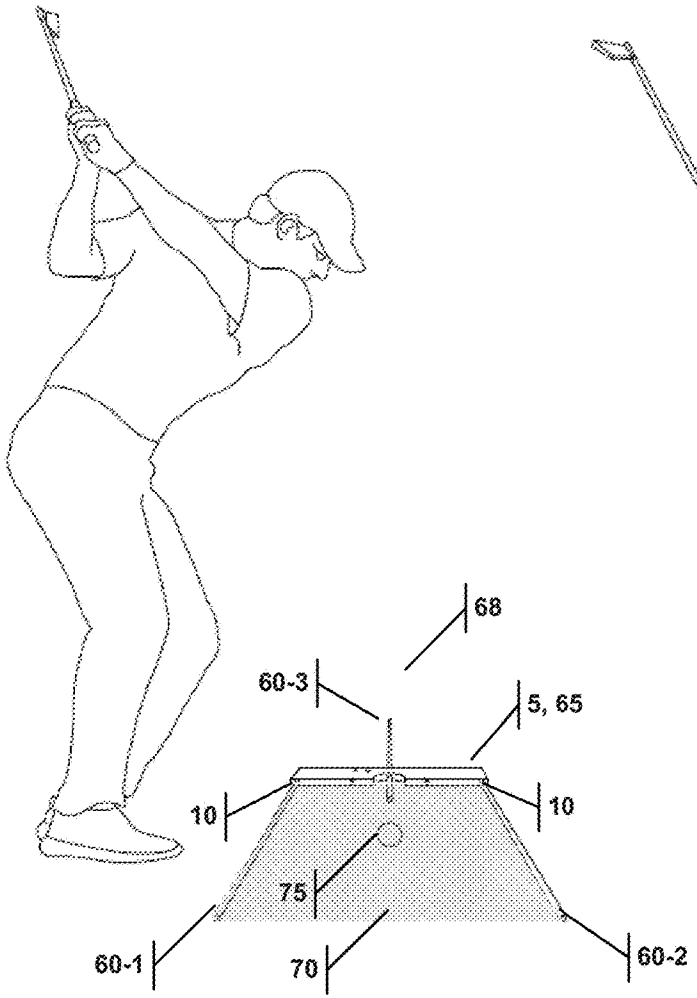
FIG.12A Wide Hitting Box Configuration

Narrow Hitting Box Configuration

Iron Swing Configuration

Iron Swing Configuration

Wood Swing Configuration

Iron Swing Configuration and Wide Hitting Box Configuration

Putting Configuration

Putting Configuration

GOLF TRAINING AID

RELATED APPLICATIONS

This application claims priority to provisional application U.S. 63/177,337, filed on Apr. 20, 2021, titled "Multi-function Golf Target Alignment Aid" and as a continuation of application U.S. Ser. No. 29/806,833, filed on Sep. 7, 2021, titled "Golf Target Alignment Aid". Both of these applications are incorporated herein by reference.

FIELD OF THE INVENTION

This invention relates to golf instruction, and more particularly to a golf training aid.

BACKGROUND

Golf is a sport in which the proper positioning and alignment, including the foot path, alignment to the target, and the swing angle, can make the difference between an expert player and a mediocre player. As an example of the importance that alignment can make, if the club-face is even one degree closed or open to the intended ball to target line at the point of impact, it can result in a miss of 10-15 yards or more, depending on the swing speed. Learning to improve positioning and alignment, therefore, is essential to becoming a better golfer, and there are a number of training aid tools and devices to assist the golfer in practicing good alignment.

In the prior art, training aids intended to improve alignment do not provide a true alignment aid with the intended target. They typically involve a first mechanism for foot path alignment, and a second mechanism for alignment intended to be the intended target line, just outside the golf club head and the ball. However, even though this second alignment aid is intended to be the target line, it is outside the area the golfer is hitting the ball, and so it fails to be the true intended target line and gives the golfer the wrong visual for the golf club to get the optimal alignment with the intended target.

Another type of training aid establishes the proper golf swing plane, but these fail to provide an intended target line apparatus. Therefore, golf swing aids could have a golfer working on his or her swing plane while not properly aligned to the desired target.

Most alignment aids currently on the market are bulky, heavy, cumbersome to use, and difficult to store and transport in a standard size golf bag.

Finally, prior art golf training alignment aids are only geared towards one aspect of the game (for instance, one aid or tool for aligning when hitting balls with a full swing, and another aid or tool for helping with putting alignment). This compounds the previous problem, as to cover all aspects of the game, you would need multiple alignment aids, making them more difficult to store and transport.

What is needed, therefore, is a system that overcomes these problems.

SUMMARY

A golf training aid is disclosed for use with alignment sticks. The golf training aid includes an elongate member with a longitudinal axis and a first and second set of holes. The first set of holes is space apart farther than the second set. The elongate ember also has a target alignment hole positioned in between the first and second set of holes. All the holes are constructed to receive and hold an alignment stick. The golf training aid has least two configurations: a wide hitting box configuration and a narrow box configuration. In the wide hitting box configuration, a first and second alignment stick are inserted into the first set of holes, and both the first and second alignment sticks (1) extend from the elongate member predominately in a first direction orthogonal to the longitudinal axis, and (2) define a wide hitting box planar area. In the narrow hitting box configuration, the first and second alignments sticks are inserted into the second set of holes, and both the first and second alignment sticks extend from the elongate member predominately in the first direction, and (2) define a narrow hitting box planar area, wherein the wide hitting box planar area is larger than the narrow hitting box planar area. In either configuration, a third alignment stick is inserted into the target alignment hole and extends from the elongate member in predominately a direction opposite to the first direction and orthogonal to the longitudinal axis. All the alignment sticks may positioned in the same plane.

The golf training aid may also include an iron swing angle hole constructed to receive an alignment stick. The golf training aid may further include an iron swing configuration wherein the first alignment stick is inserted into one of the first set of holes and the second alignment stick is inserted into the iron swing angle hole, the second alignment stick (1) extends away from the elongate member in a second direction orthogonal to the longitudinal axis and the first direction and (2) forms an iron swing angle (42) with the longitudinal axis, the iron swing angle is in the range of 50-60 degrees.

The golf training aid may also include a wood swing angle hole constructed to receive an alignment stick. The golf training aid may further include a wood swing configuration wherein the first alignment stick is inserted into one of the first set of holes and the second alignment stick is inserted into the wood swing angle hole, the second alignment stick (1) extends away from the elongate member in a second direction orthogonal to the longitudinal axis and the first direction and (2) forms a wood swing angle (47) with the longitudinal axis, the wood swing angle is in the range of 40-50 degrees.

The golf training aid may also include a putting hole constructed to allow a golf ball to pass there through, a third set of two holes each constructed to receive an alignment stick and a putting target alignment hole constructed to receive an alignment stick, the putting alignment hole positioned above the putting hole and in between the third set of holes. The golf training aid may further include a putting configuration wherein (1) the first and second alignment sticks are inserted into the third set of holes and both the first and second alignment sticks extend orthogonally from the longitudinal axis and define a putting box plane, and (2) the third alignment sticks is inserted into the putting target alignment hole and extends orthogonally from the longitudinal axis and is elevated from the putting box plane by more than the diameter of the golf ball.

The elongate member of the golf training aid may be a rectangular prism with a major face. When the golf training aid is in the wide hitting box configuration and the narrow hitting box configuration, the first and second alignment sticks may be parallel to the major face. When the golf training aid is in the putting configuration, the first and second alignment sticks may be orthogonal to the major face.

The golf training aid may have a stick storage rack attached to the elongate member, the alignment stick storage rack includes a plurality of storage rack holes constructed to receiver alignment sticks.

Various methods of using the device are also disclosed.

Additional aspects, alternatives and variations as would be apparent to persons of skill in the art are also disclosed herein and are specifically contemplated as included as part of the invention. The invention is set forth only in the claims as allowed by the patent office in this or related applications, and the following summary descriptions of certain examples are not in any way to limit, define or otherwise establish the scope of legal protection.

BRIEF DESCRIPTION OF THE DRAWINGS

The invention can be better understood with reference to the following figures. The components within the figures are not necessarily to scale, emphasis instead being placed on clearly illustrating example aspects of the invention. In the figures, like reference numerals designate corresponding parts throughout the different views and/or embodiments. Furthermore, various features of different disclosed embodiments can be combined to form additional embodiments, which are part of this disclosure. It will be understood that certain components and details may not appear in the figures to assist in more clearly describing the invention.

FIG. 12A illustrates the use of the golf training aid in the wide hitting box configuration.

FIG. 12B is a top view of the use illustrated in FIG. 12A, showing two alignment sticks defining a wide hitting box and a third alignment stick aligning the hitting box with the golf pin (not shown).

DETAILED DESCRIPTION

Figure 1:
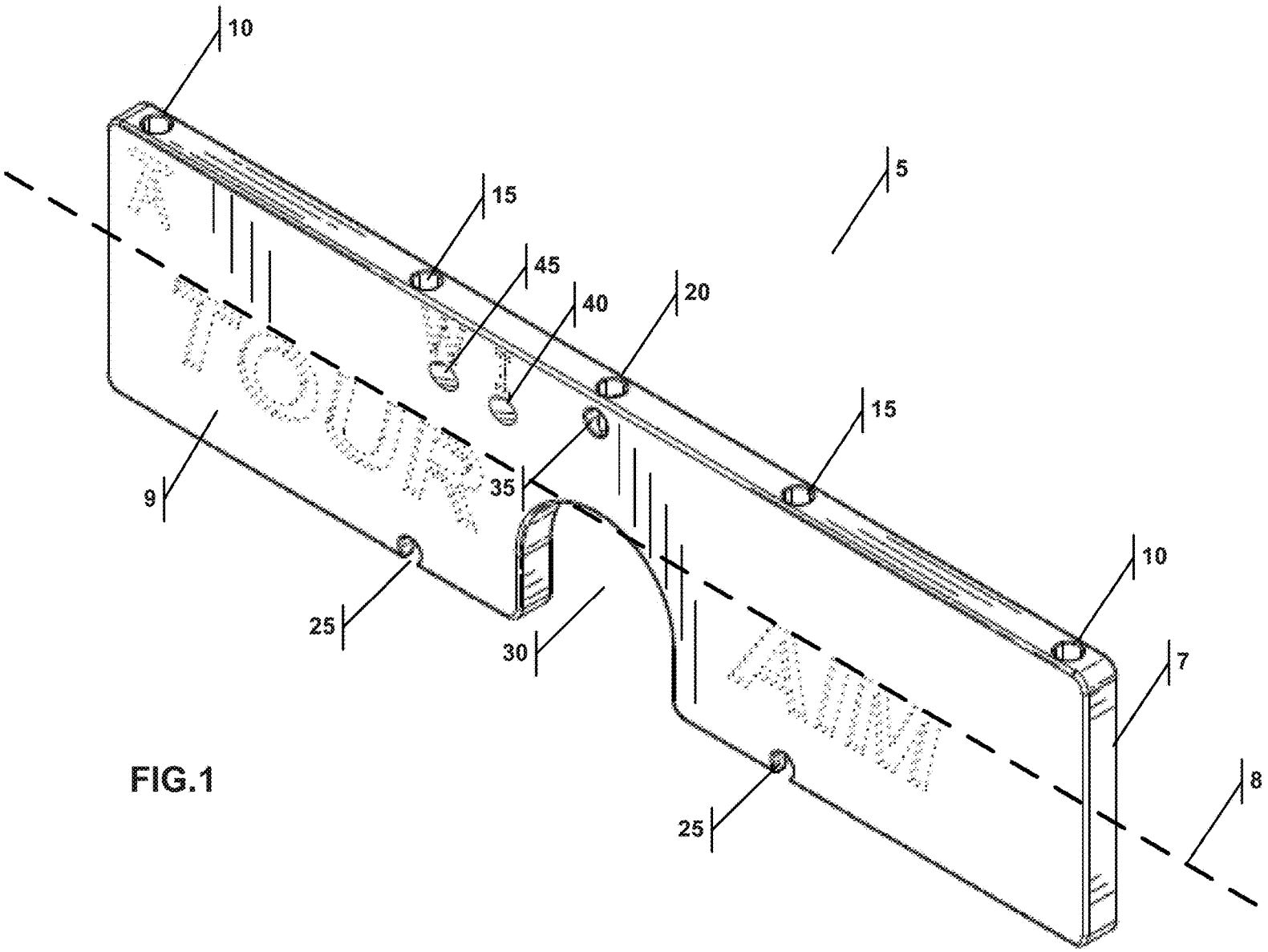
FIG. 1 is a perspective view of a novel golf training aid.

Reference is made herein to some specific examples of the present invention, including any best modes contemplated by the inventor for carrying out the invention. Examples of these specific embodiments are illustrated in the accompanying figures. While the invention is described in conjunction with these specific embodiments, it will be understood that it is not intended to limit the invention to the described or illustrated embodiments. To the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, process operations well known to persons of skill in the art have not been described in detail in order not to obscure unnecessarily the present invention. Various techniques and mechanisms of the present invention will sometimes be described in singular form for clarity. However, it should be noted that some embodiments include multiple iterations of a technique or multiple mechanisms, unless noted otherwise. Similarly, various steps of the methods shown and described herein are not necessarily performed in the order indicated, or performed at all, in certain embodiments. Accordingly, some implementations of the methods discussed herein may include more or fewer steps than those shown or described. Further, the techniques and mechanisms of the present invention will sometimes describe a connection, relationship or communication between two or more entities. It should be noted that a connection or relationship between entities does not necessarily mean a direct, unimpeded connection, as a variety of other entities or processes may reside or occur between any two entities. Consequently, an indicated, connection does not necessarily mean a direct, unimpeded connection, unless otherwise noted.

The following list of example features corresponds to the attached figures and is provided for ease of reference, where like reference numerals designate corresponding features throughout the specification and figures:

Golf Training Aid 5
Elongate Member 7
Longitudinal Axis 8
Major Face 9
Wide Hitting Box Holes (First Set of Holes) 10
First Distance 12
Narrow Hitting Box Holes (Second Set of Holes) 15
Second Distance 17
Target Alignment Hole 20
Putting Hitting Box Holes 25
Putting Ball Pass Through 30
Putting Target Alignment Hole 35
Iron Swing Angle Hole 40
Iron Swing Configuration 41
Iron Swing Angle 42
Iron Swing Plane 43
Iron Swing Hole Distance From Target Alignment Hole 44
Wood Swing Angle Hole 45
Wood Swing Configuration 46
Wood Swing Angle 47
Wood Swing Plane 48
Wood Swing Hole Distance From Target Alignment Hole 49
Alignment Stick Storage Rack 50
Storage Rack Holes 55
Alignment Sticks 60-1, 60-2, 60-3, 60-4
Flat Orientation 65
Wide Hitting Box Configuration 68
Wide Hitting Planar Box (Shaded) 70
Golf Ball 75
Golf Tee 80
Narrow Hitting Box Configuration 82
Narrow Hitting Planar box (Shaded) 85
Upright Position 90
Putting Hitting Box 95
Putting Configuration 97
Golf Cup 100
Putting Ball Travel Path 105

The present invention presents many embodiments and many aspects that may be used independently or in conjunction.

As illustrated in FIGS. 1-7, the golf training aid 5 of the present invention is for use with standard alignment sticks 60-1, 60-2, 60-3, 60-4 and comprises an elongate member 7 with a longitudinal axis 8 having a first set of two holes 10, a second set of two holes 15, and a target alignment hole 20. Each hole 10 in the first set of two holes is constructed to receive an alignment stick, and the first set of holes has the two holes 10 spaced apart from each other by a first distance 12 (see FIG. 5). Each hole 15 in the second set of two holes is constructed to receive an alignment stick, and the second set of holes has the two holes 15 spaced apart from each other by a second distance 17; note that the first distance 12 is larger than the second distance 17. The target alignment hole 20 is constructed to receive an alignment stick, and is positioned in between the first and second set of holes.

Figure 8:
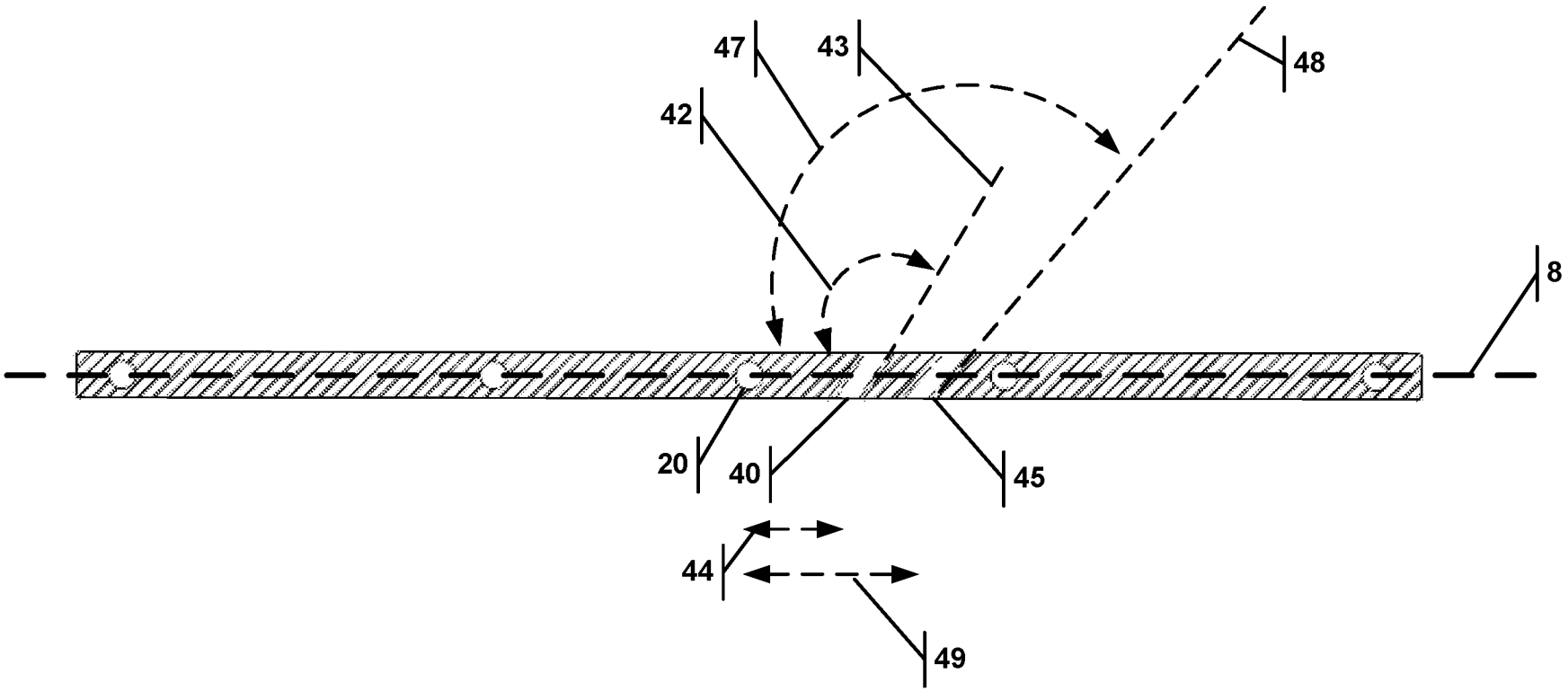
FIG. 8 is a cross-sectional view taken along the line 8-8 shown in FIG. 2.

The golf training aid 5 as illustrated in FIG. 1 also features an iron swing angle hole 40 constructed to receive an alignment stick, a wood swing angle hole 45 constructed to receive an alignment stick, a putting hole 30 constructed to allow a golf ball to pass there through, a third set of two holes 25 each constructed to receive an alignment stick, and a putting target alignment hole 35 constructed to receive an alignment stick, where the putting alignment hole 35 is positioned above the putting hole 30 and in between the third set of two holes. These additional elements allow for the golf training aid 5 to have even more configurations to cover all aspects of golfing where alignment is desired to facilitate training. The angled holes 40 and 45 can be specifically spaced such that the target alignment line intersects at the club face's sweet spot. In one embodiment the iron swing angle hole 40 is positioned 1.37 inches+/−0.5 inches from the alignment hole 20, and the wood swing angle hole 45 is positioned 2.24 inches+/−0.5 inches from the alignment hole 20. These locations or positions of the holes 40 and 45 can be taken with the assumption that most drivers or irons have the same center of club-face to center of shaft dimensions; these correlate to the true target line and to the true target alignment hole 20. The angles shown in FIG. 8 are the angles made with the longitudinal axis 8, which are complementary to the aforementioned angles.

The golf training aid 5 comprises at least two configurations: a wide hitting box configuration 68 and a narrow hitting box configuration 82. In the wide hitting box configuration 68, a first alignment stick 60-1 and a second alignment stick 60-2 are inserted into the first set of holes 10, and both the first and second alignment sticks 60-1, 60-2 (1) extend from the elongate member 7 predominately in a first direction orthogonal to the longitudinal axis 8, and (2) define a wide hitting box planar area 70. This wide hitting box configuration 68 can be seen in FIGS. 11, 12A-12B, and 16A-16B. In the narrow hitting box configuration 82, the first and second alignment sticks 60-1, 60-2 are inserted into the second set of holes 15, and both the first and second alignment sticks 60-1, 60-2 (1) extend from the elongate member 7 predominately in the first direction orthogonal to the longitudinal axis 8, and (2) define a narrow hitting box planar area 85 (seen in FIGS. 13A-13B). Note that the wide hitting box planar area 70 is larger than the narrow hitting box planar area 85. In both the wide hitting box and narrow hitting box configurations (68, 82), a third alignment stick 60-3 is inserted into the target alignment hole 20 and extends from the elongate member 7 in predominately a direction opposite to the first direction (i.e., towards the intended target) and orthogonal to the longitudinal axis 8. The alignment sticks are in the same plane for each of the aforementioned configurations of the golf training aid 5. As illustrated in FIGS. 1, 4-5, and 8-10, the holes (10, 15, 20) constructed to hold the alignment sticks in the wide hitting box and narrow hitting box configurations (68, 82) run from the elongate member 7 top surface through the other side to the bottom surface. When the golf training aid 5 is used in these configurations, it is laid in a flat orientation 65, as shown in FIGS. 11-16B, so that the alignment sticks inserted into the wide hitting box holes 10, narrow hitting box holes 15, and the target alignment hole 10 are parallel to the ground. Note that in each configuration, the alignment sticks 60-1, 60-2, and 60-3 are parallel to each other.

Figure 2:
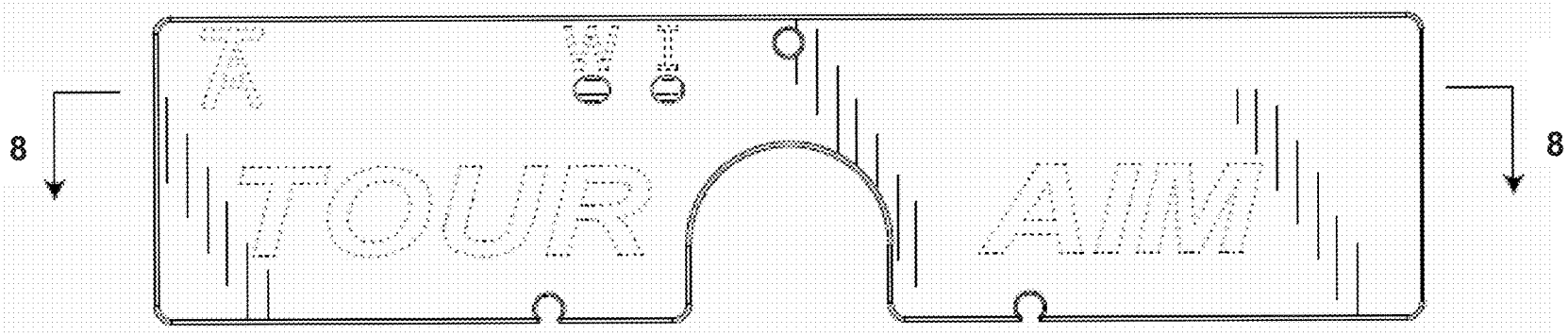
FIG. 2 is a front view of the golf training aid.
Figure 3:
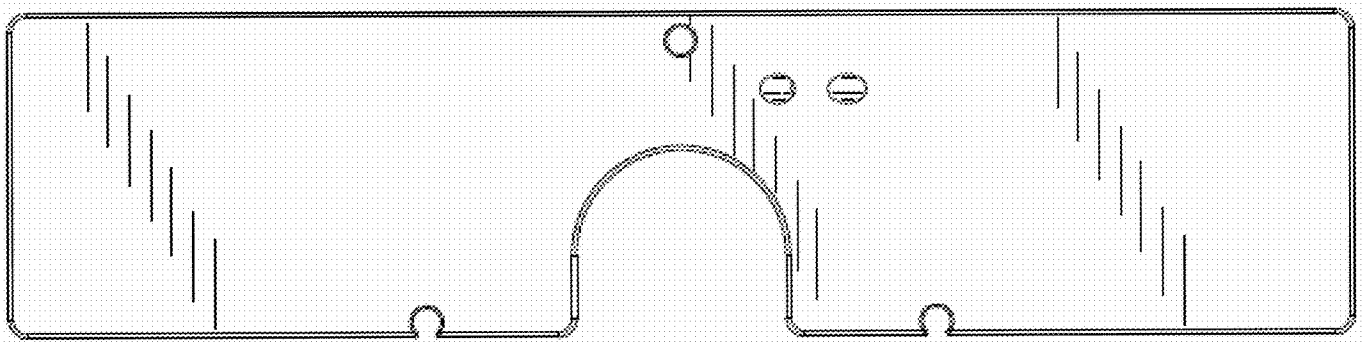
FIG. 3 is a back view of the golf training aid.
Figures 4, 5, 6, 7:
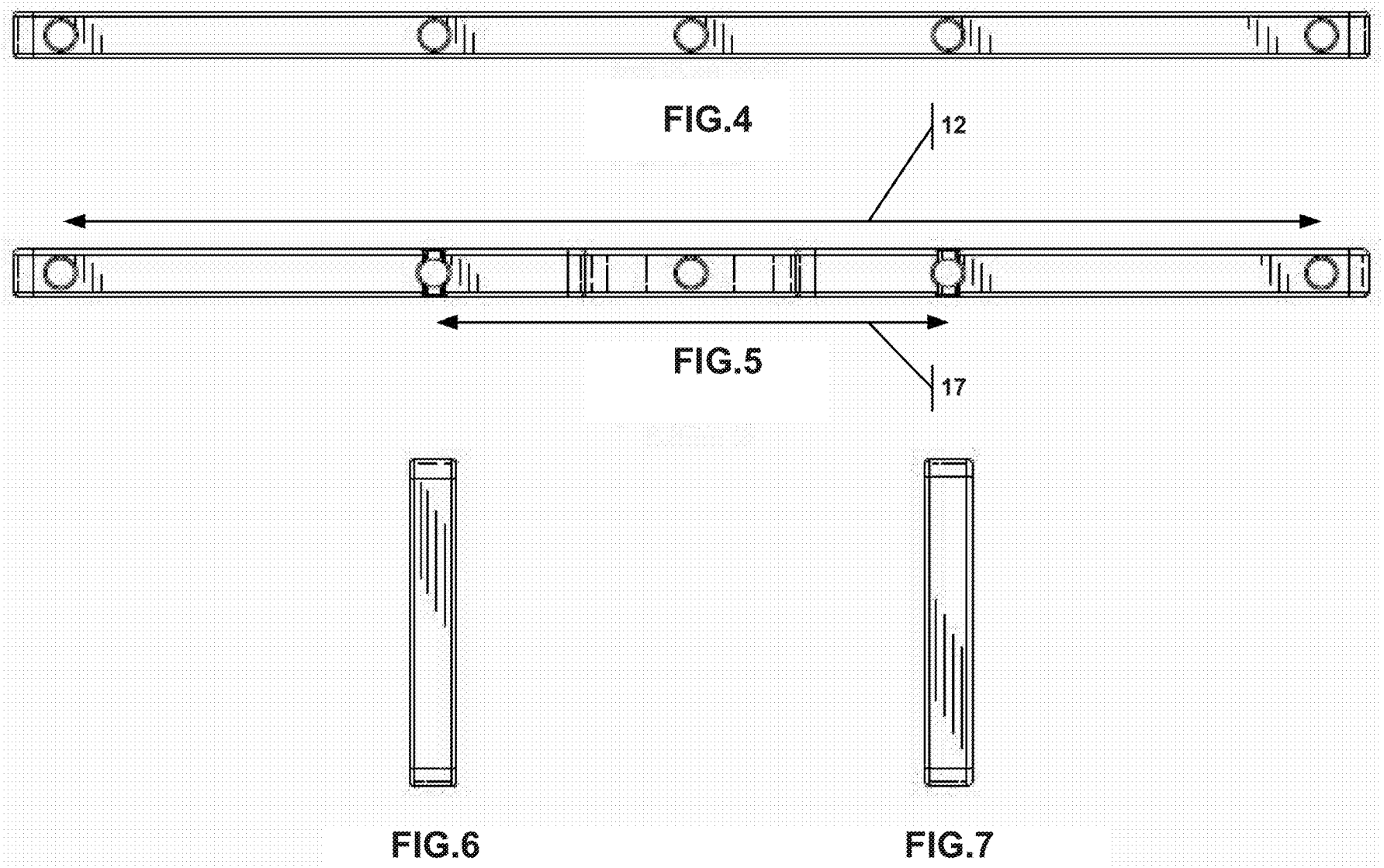
FIG. 4 is a top view of the golf training aid.
FIG. 5 is a bottom view of the golf training aid.
FIG. 6 is a left side view of the golf training aid.
FIG. 7 is a right side view of the golf training aid.

The putting hitting box holes 25, putting ball pass through 30, putting target alignment hole 35, iron swing angle hole 40, and wood swing angle hole 45 instead run from the front of the major face 9 to the back of the elongate member 7 (shown in FIGS. 2-3). The iron swing angle hole 40 enables an iron swing configuration 41 for the golf training aid 5, wherein a first alignment stick (60-3 in FIGS. 14A-14C) is inserted into one of the first set of holes 10, and the second alignment stick (60-2 in FIGS. 14A-14C) is inserted into the iron swing angle hole 40; the second alignment stick (1) extends away from the elongate member 7 in a second direction orthogonal to the longitudinal axis and the first direction and (2) forms an iron swing angle 42 with the longitudinal axis 8. Shown in FIG. 8, the iron swing angle 42 is optimally 56 degrees but may be in the range of 50-60 degrees, making for an iron swing hole distance 44 from the target alignment hole 20 of the golf training aid 5. The wood swing angle hole 45 enables a wood swing configuration 46 for the golf training aid 5, wherein a first alignment stick (60-3 in FIGS. 15A-15B) is inserted into one of the first set of holes 10, and the second alignment stick (60-2 in FIGS. 15A-15B) is inserted into the wood swing angle hole; the second alignment stick (1) extends away from the elongate member 7 in a second direction orthogonal to the longitudinal axis 8 and the first direction and (2) forms a wood swing angle 47 with the longitudinal axis 8. Shown in FIG. 8, the wood swing angle 47 is optimally 48 degrees but may be in the range of 40-50 degrees, making for a wood swing hole distance 49 from the target alignment hole 20 of the golf training aid 5. In general, the wood swing hole distance 49 is greater than the iron swing hole distance 44, and the angle for each is selected to optimize the angle formed by the alignment stick when inserted into the iron swing angle hole 40 or the wood swing angle hole 45. It should be obvious that either the iron swing configuration 41 or the wood swing configuration 46 may be used in conjunction with the wide hitting box configuration 68 or the narrow hitting box configuration 82; this requires only one additional alignment stick 60-4 instead of a second separate aid or tool, as required by the prior art. FIGS. 16A-16B, for example, show the iron swing configuration 41 simultaneously used in conjunction with the wide hitting box configuration 68. In FIGS. 16A-16B, the first and second alignment sticks 60-1, 60-2 are inserted into the first set of holes 10 to establish the wide hitting planar box area 70. The alignment stick 60-3 is inserted into the target alignment hole 20, and the alignment stick 60-4 is inserted into the iron swing angle hole 40, so that all aspects of the desired alignment are covered with one multi-functional golf training aid 5.

In either the iron swing configuration 41 or the wood swing configuration 46, if the golfer places a club shaft on the alignment stick that is placed in the angled hole 40 or 45 the golf training aid 5 will guide the alignment of the sweet spot of the club-face while providing a visual for the true target line with the target alignment hole 20, so that the golfer can both hit the ball with the sweet spot of the club-face, and do so while in a true alignment with the intended target, which is a big advantage over prior art, which requires use of separate independent aids for swing alignment and for target alignment.

In another aspect, the golf training aid 5 comprises also a putting configuration 97 wherein (1) the first and second alignment sticks (60-1, 60-2 in FIGS. 17A-18B) are inserted into the third set of holes 25 and both the first and second alignment sticks 60-1, 60-2 extend orthogonally from the longitudinal axis 8 and define a putting box plane 95, and (2) the third alignment stick 60-3 is inserted into the putting garget alignment hole 35 and extends orthogonally from the longitudinal axis 8 and is elevated from the putting box plane 95 by more than the diameter of the golf ball. Here, the golf training aid 5 is in an upright position 90 instead of in a flat orientation 65. In the putting configuration 97, when the golfer puts the golf ball 75, the golf ball 75 travels under the third alignment stick 60-3, through the putting hole pass through 30 in the putting ball travel path 105 towards the golf cup or pin 100. The putting ball travel path 105 is substantially in the same direction as the first direction (target line) indicated by the alignment stick 60-3 when it is inserted through the putting alignment hole 30 and aligned towards the intended target, in this case the golf hole or pin 100. The golfer has the option of positioning the alignment stick 60-3 in FIGS. 17A-18B through the putting target alignment hole 35 such that the alignment stick 60-3 extends only a short distance over the putting hitting box 95, or extends over the entire length over the putting hitting box 95.

When the elongate member 7 of the golf training aid 5 is a rectangular prism, as shown in FIGS. 1-10 with a major face 9, then the following may be true. When the golf training aid 5 is in the wide hitting box configuration 68 and/or in the narrow hitting box configuration 82, the first and second alignment sticks are parallel to the major face 9. When the golf training aid 5 is in the putting configuration 97, the first and second alignment sticks are orthogonal to the major face 9.

Figure 9B:
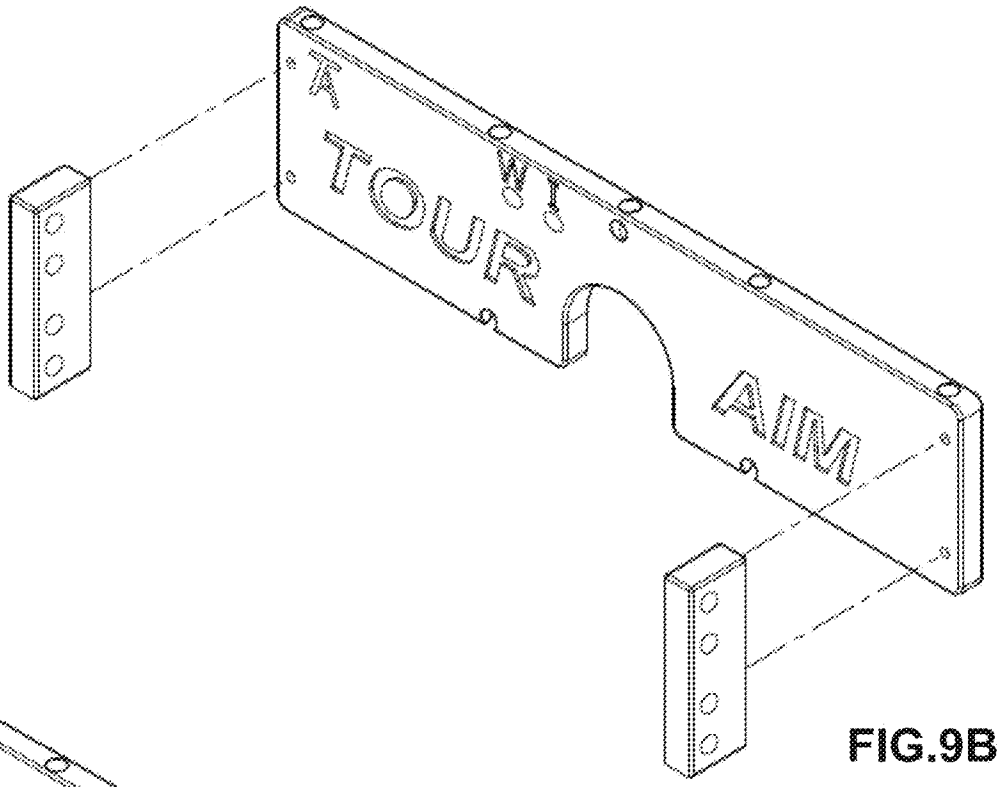
FIG. 9B illustrates a mounting position of the rack.
Figure 9A:
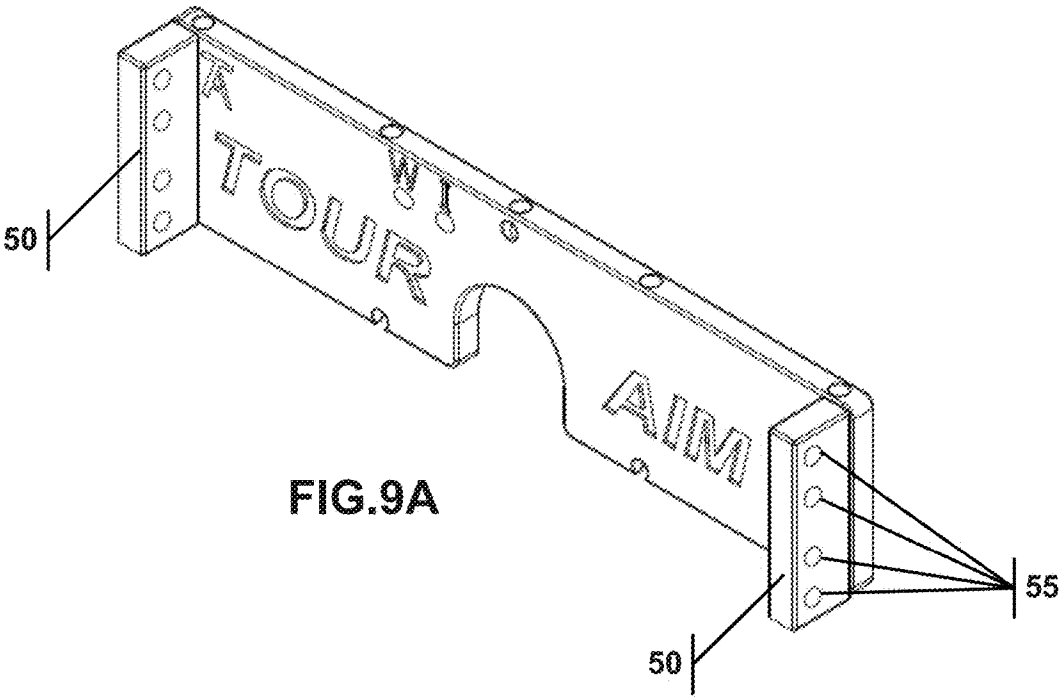
FIG. 9A illustrates the golf training aid with a rack for storing the alignment sticks.
Figure 10:
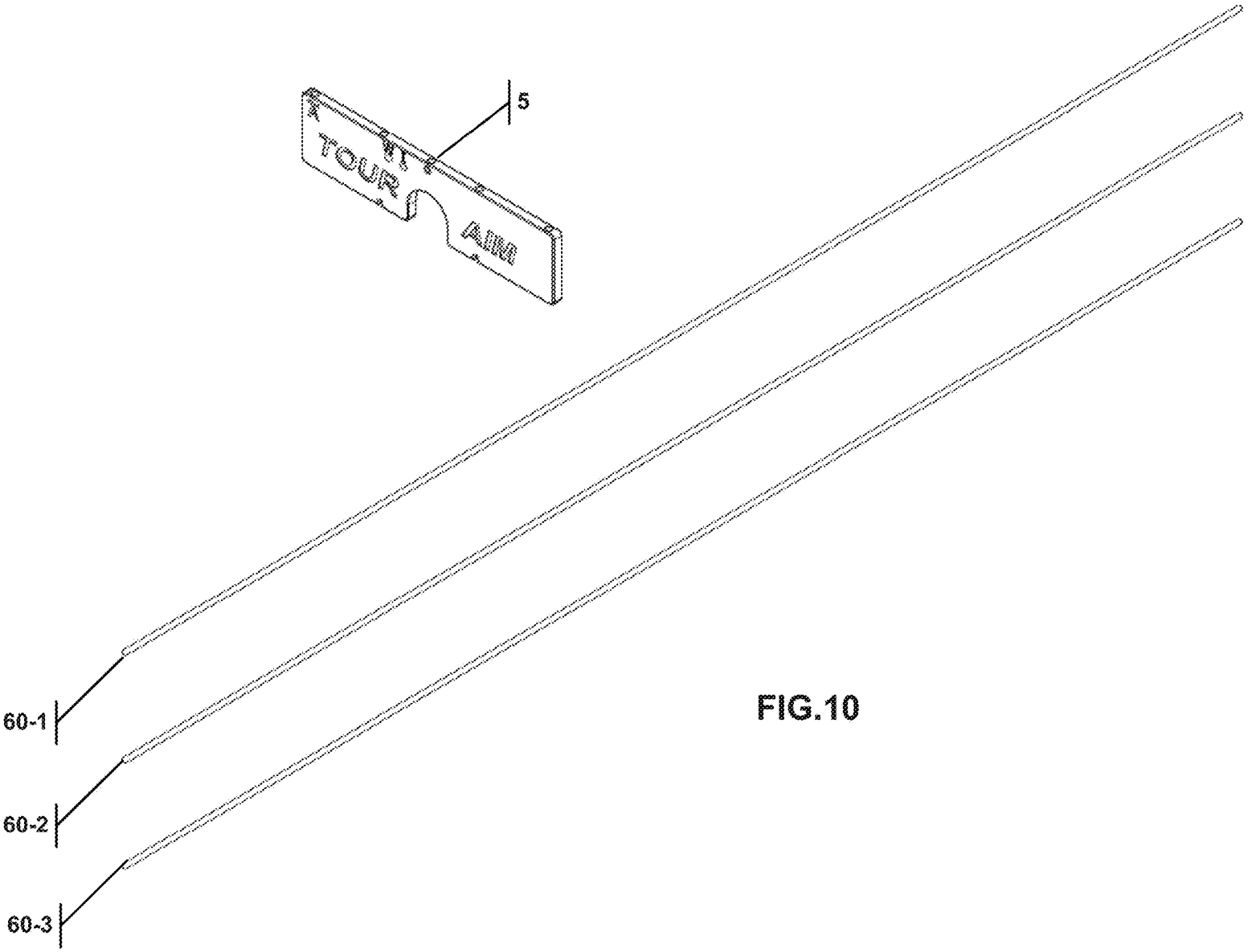
FIG. 10 illustrates the golf training aid along with three alignment sticks.
Figure 11:
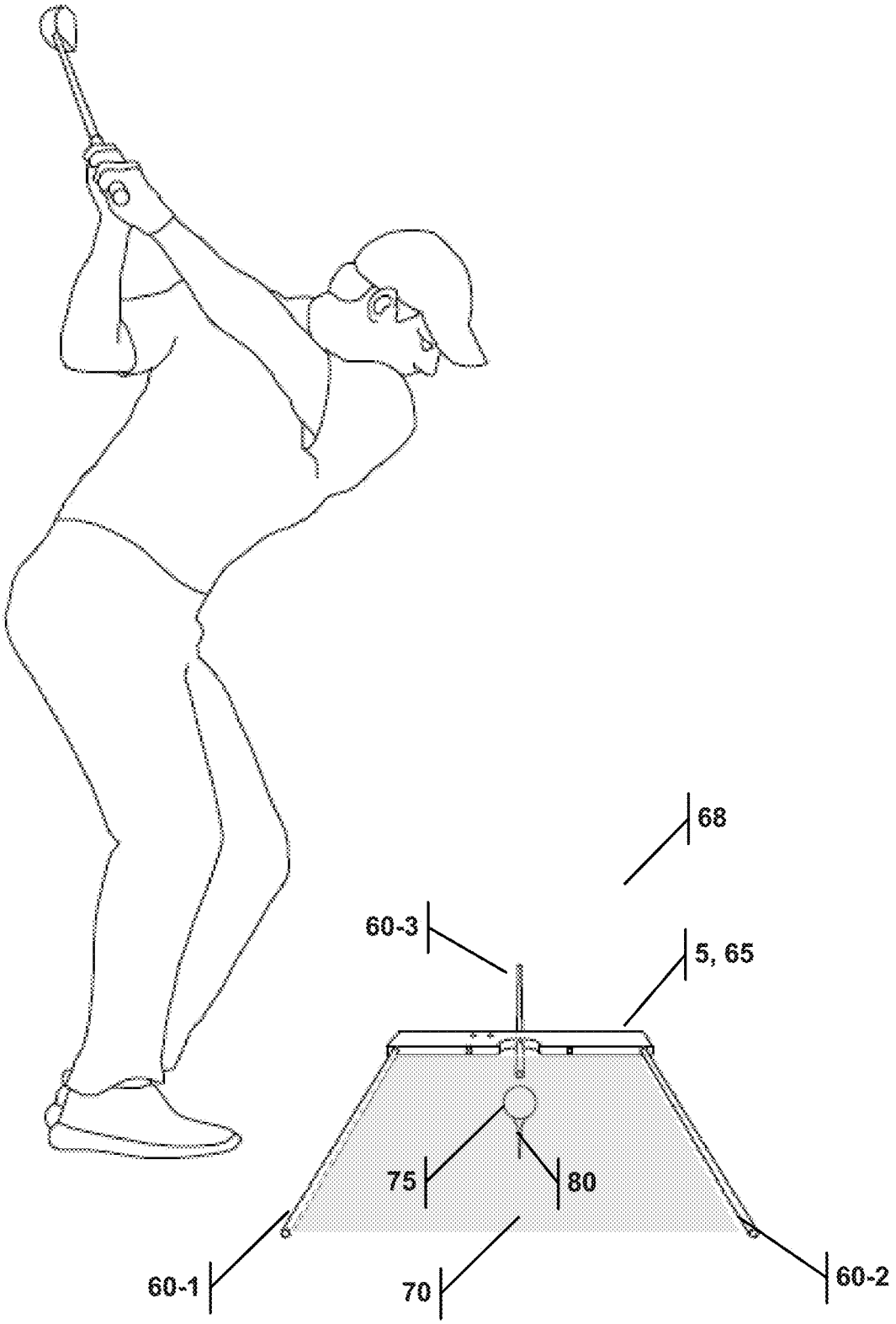
FIG. 11 illustrates the use of the golf training aid in a wide hitting box configuration.

As illustrated in FIGS. 9A-9B, the golf training aid 5 may further comprise an alignment stick storage rack 50 comprised of two pieces attached to the elongate member 7. The alignment stick storage rack 50 comprises a plurality of storage rack holes 55 that are each constructed to receive standard-sized, readily available alignment sticks. This enables ease of storage and transport, which is yet another improvement upon prior art, which had entailed carrying or storing multiple sets of tools or aids to cover all aspects of alignment in golfing. In contrast, the golf training aid 5 of the present invention is small, lightweight, easy to store, and multi-functional to guide both swing alignment and target alignment in one multi-functional aid/tool.

The wide hitting box configuration 68 is meant for hitting the golf ball 75 either with a golf tee 80 (FIG. 11), or without a golf tee (FIG. 12A-B). The first and second alignment sticks 60-1, 60-2 establish the rectangular hitting area and correct foot path alignment, while the third alignment stick 60-3 through the target alignment hole 20 provides a true intended target line, which visually cues the golfer to the desired travel path for the golf ball to reach the intended target. The larger/wider rectangular hitting area is established by inserting the alignment sticks 60-1, 60-2 through the wide hitting box holes 10, while the alignment stick 60-3 establishing the target alignment line in true alignment with the target is inserted through the target alignment hole 20 so that it extends in the opposite direction from 60-1 and 60-3.

Figures 13A, 13B:
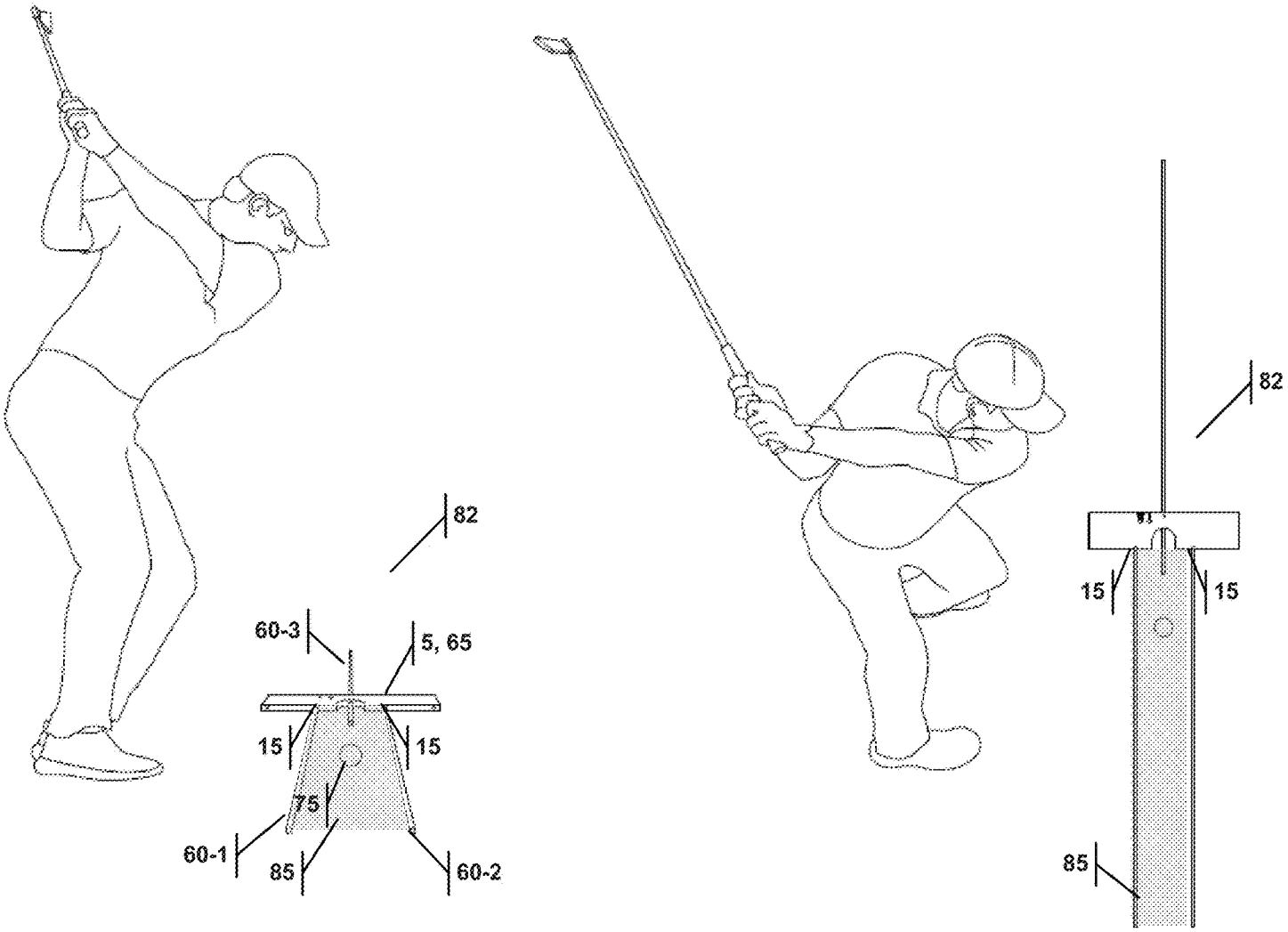
FIG. 13A illustrates the use of the golf training aid in a narrow hitting box configuration.
FIG. 13B is a top view of the use illustrated in FIG. 12A, showing two alignment sticks defining a narrow hitting box and a third alignment stick aligning the hitting box with the golf pin (not shown).

The narrow hitting box configuration 82 illustrated in FIGS. 13A-13B likewise establish the rectangular hitting area and correct foot path alignment with the alignment sticks 60-1, 60-2, but a narrower hitting area setup is more suited for chipping and pitching. Likewise, the third alignment stick 60-3 through the target alignment hole 20 provides a true intended target alignment line when extended in the opposite direction from 60-1 and 60-2, which are inserted through the narrow hitting box holes 15.

Figure 14B:
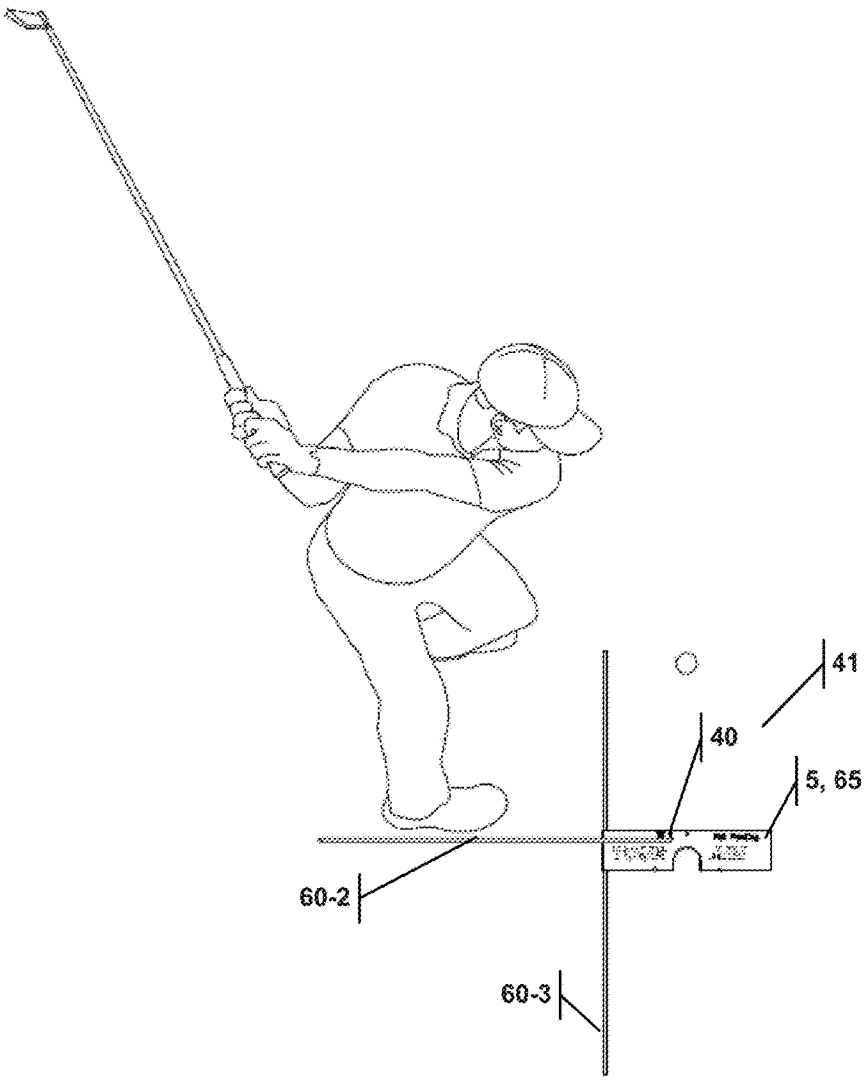
FIG. 14B is a top view of the use shown in FIG. 14A.
Figure 14A:
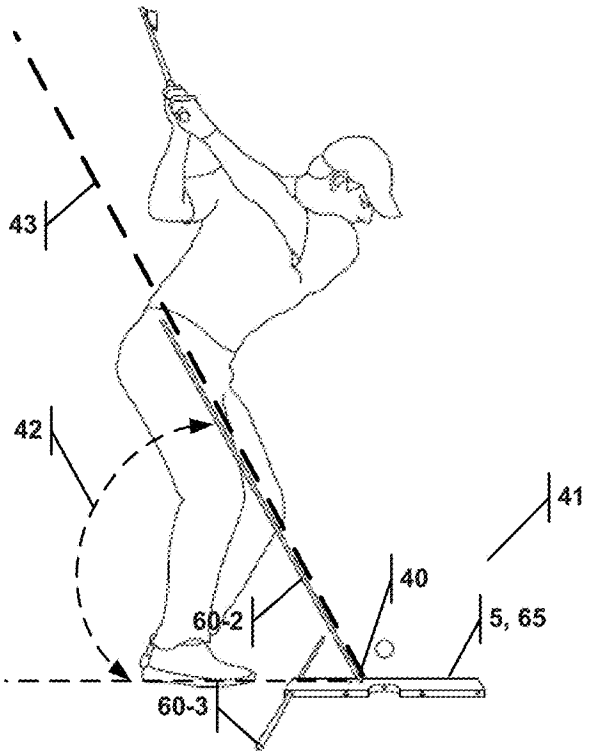
FIG. 14A illustrates the use of the golf training aid in an iron swing configuration, more specifically as a swing aid before the ball strike wherein a first alignment stick points at the golf pin (not shown) and a second alignment stick extends away from the golf training aid at angle that is optimal for use with irons.
Figure 14C:
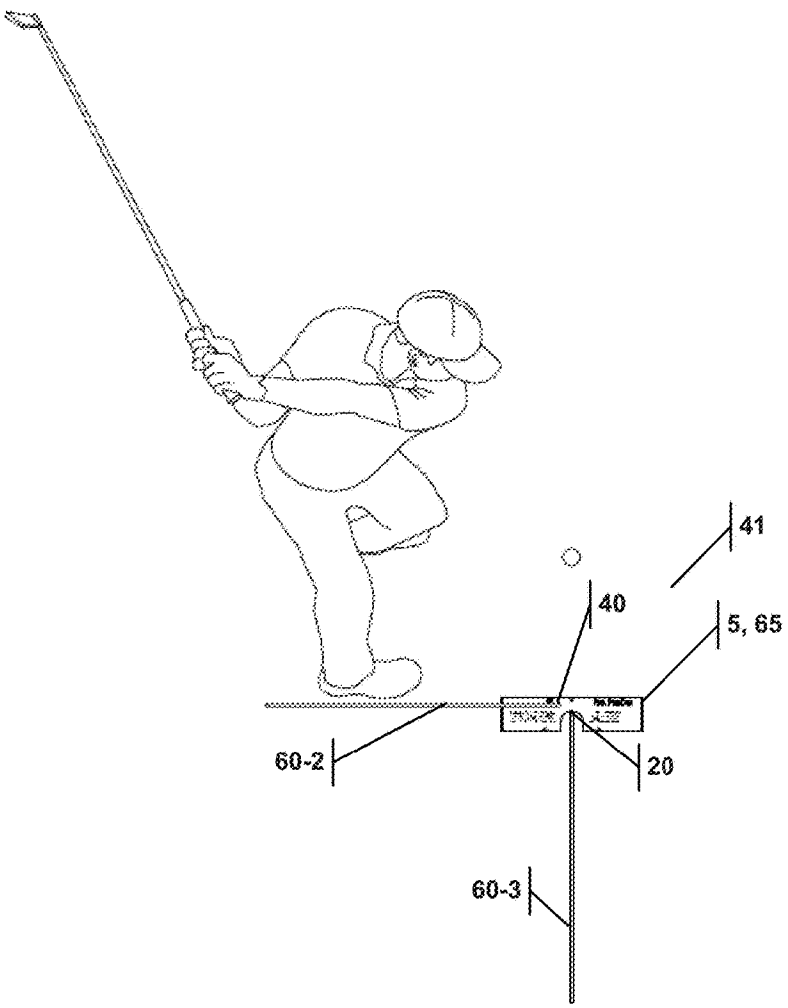
FIG. 14C illustrates the use of the golf training aid in an iron swing configuration, more specifically as a swing aid before the ball strike wherein a first alignment stick points at the golf pin (not shown), and may be used to better align the backswing.

FIGS. 14A-B show an iron swing configuration 41, where another alignment stick can be inserted into the iron swing angle hole 40 to establish the iron swing plane 43 that forms an iron swing angle 42 with the longitudinal axis 8 of the golf training aid 5, and guides the golfer's swing to guide it toward an optimal swing angle for an iron swing. In FIG. 14C the alignment stick 60-3 is placed in the target alignment hole 20, which allows the golfer to better align her backswing with the target line.

Figure 15B:
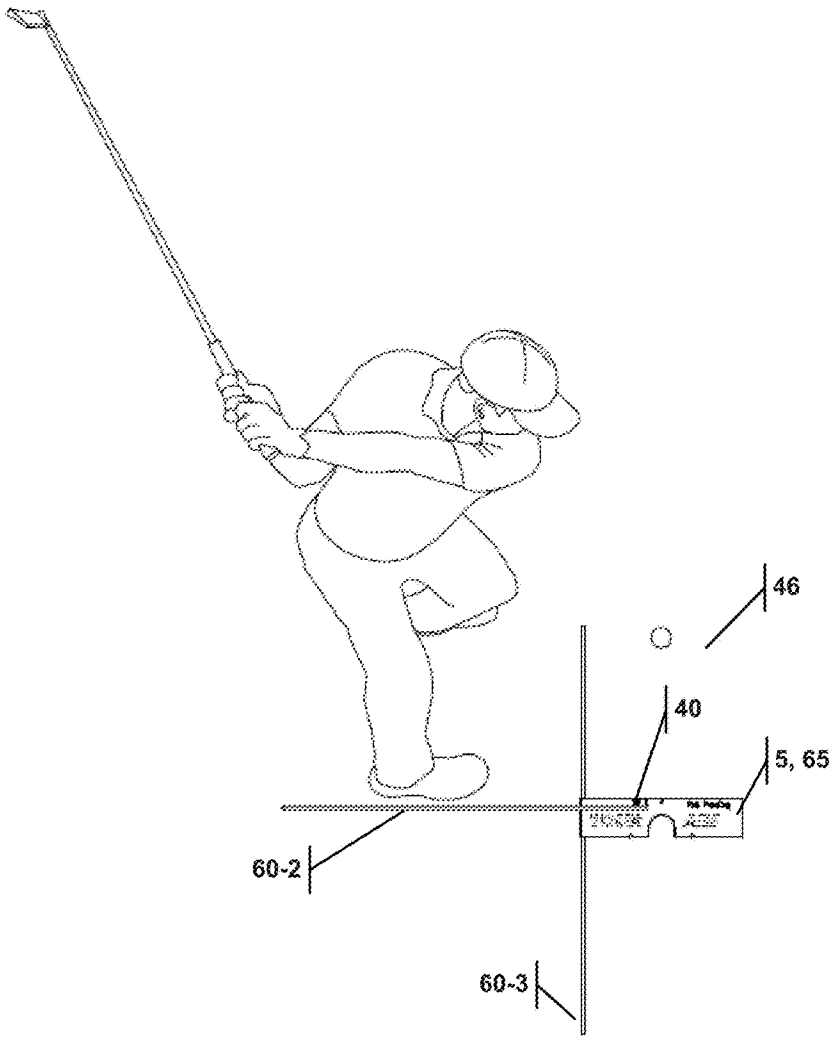
FIG. 15B is a top view of the use shown in FIG. 15A.
Figure 15A:
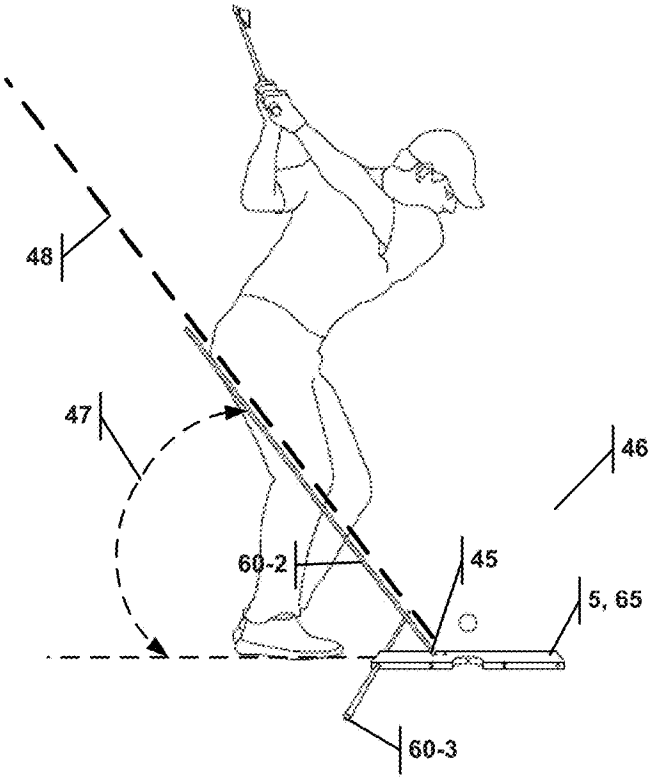
FIG. 15A illustrates the use of the golf training aid in a wood swing configuration, more specifically as a swing aid before the ball strike wherein a first alignment stick points at the golf pin (not shown) and a second alignment stick extends away from the golf training aid at angle that is optimal for use with woods.
Figure 16B:
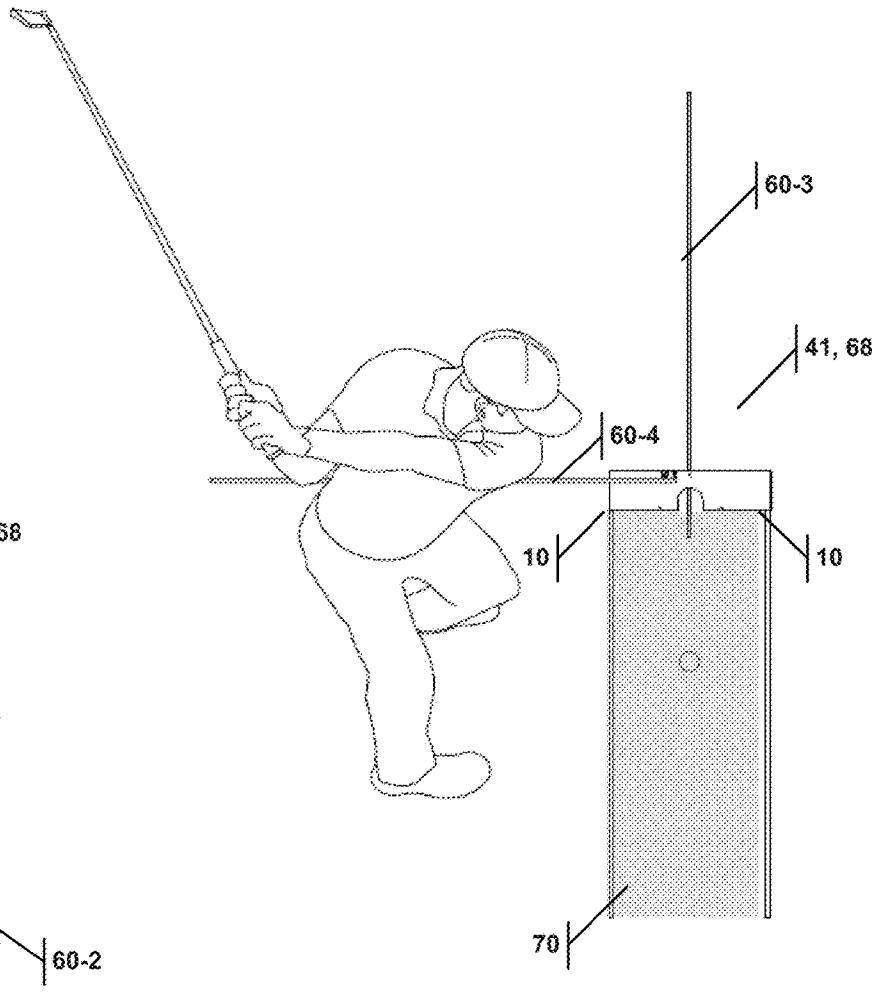
FIG. 16B is a top view of the use shown in FIG. 16A.
Figure 16A:
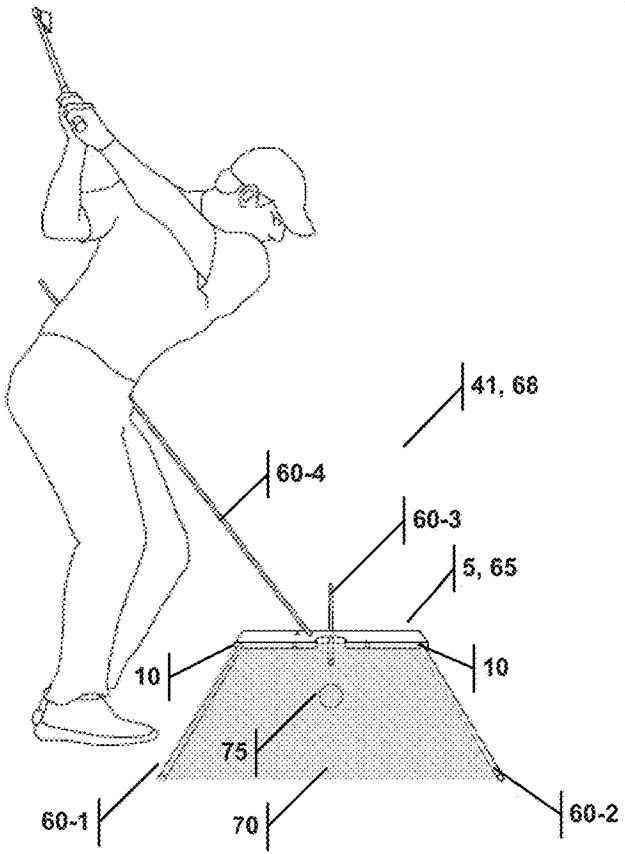
FIG. 16A illustrates the use of the golf training aid in both the iron swing configuration and the wide hitting box configuration. The golf aid is (1) an alignment aid for use when driving the golf ball with an iron, showing two alignment sticks defining a wide hitting box and a third alignment stick aligning the hitting box with the golf pin (not shown), and (2) as a swing aid after the ball strike wherein a fourth alignment stick extends away from the golf training aid at angle that is optimal for use with irons.
Figure 17B:
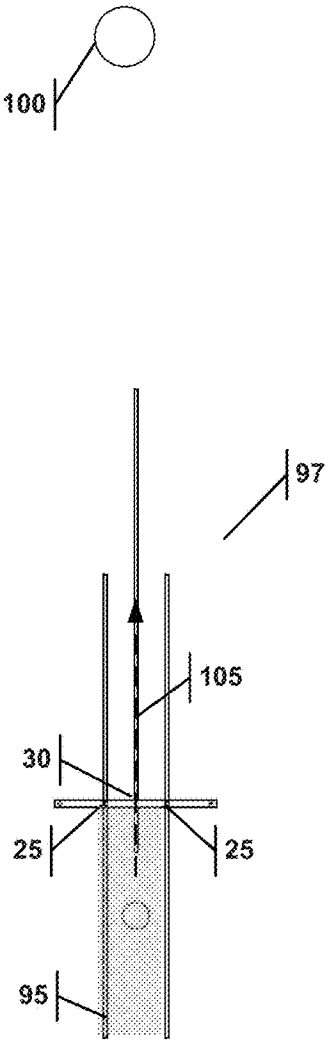
FIG. 17B is a top view of the use illustrated in FIG. 17A, wherein two alignment sticks define a plane and putting hitting box, and a third alignment stick is positioned higher than the plane, allowing (1) the golfer to swing the putter underneath the third alignment stick, and (2) the ball to travel underneath the third alignment stick and through the golf training aid.
Figure 17A:
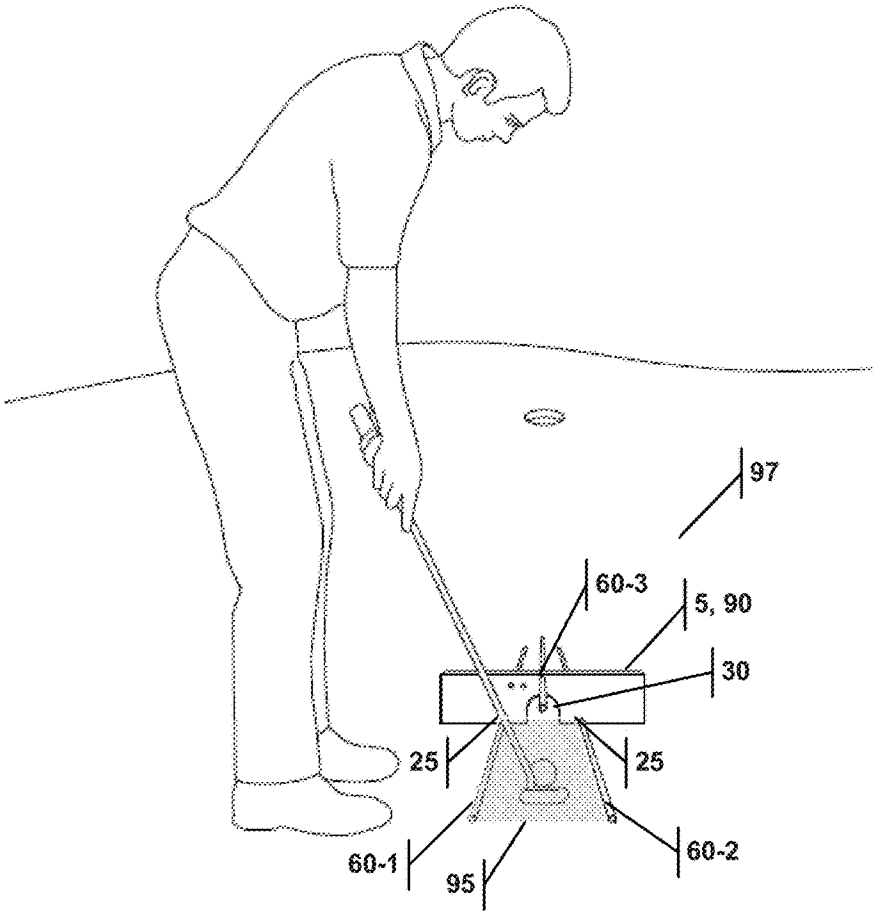
FIG. 17A illustrates the use of the golf training aid in the putting configuration, more specifically as an alignment aid for use when putting the ball.

FIGS. 15A-B demonstrate a wood swing configuration 46, where another alignment stick can be inserted into the wood swing angle hole 45 to establish the wood swing plane 48 that forms a wood swing angle 47 with the longitudinal axis 8 of the golf training aid 5, and guide's the golfer's swing to guide it toward an optimal swing angle for a wood swing.

FIGS. 16A-B present how four alignment sticks may be used simultaneously, to achieve correct foot path alignment with the hitting box 70 established by the first and second alignment sticks 60-1, 60-2, the correct target alignment with the third alignment stick 60-3 through the target alignment hole 20, and the correct swing alignment with the fourth alignment stick 60-4 providing the right angle for the swing.

Figure 18B:
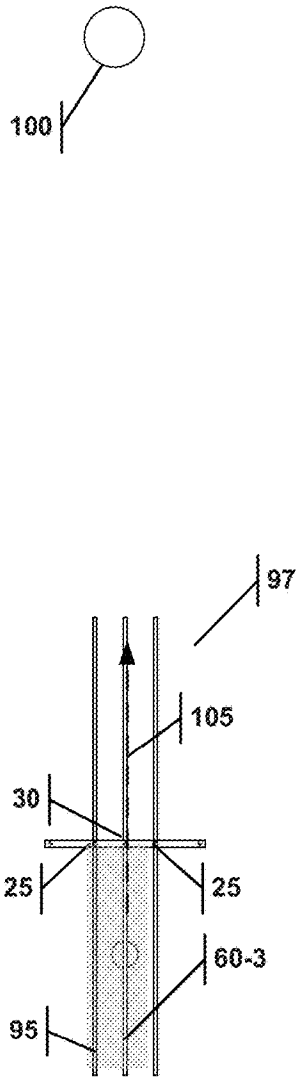
FIG. 18B is a top view of the use illustrated in FIG. 18A.
Figure 18A:
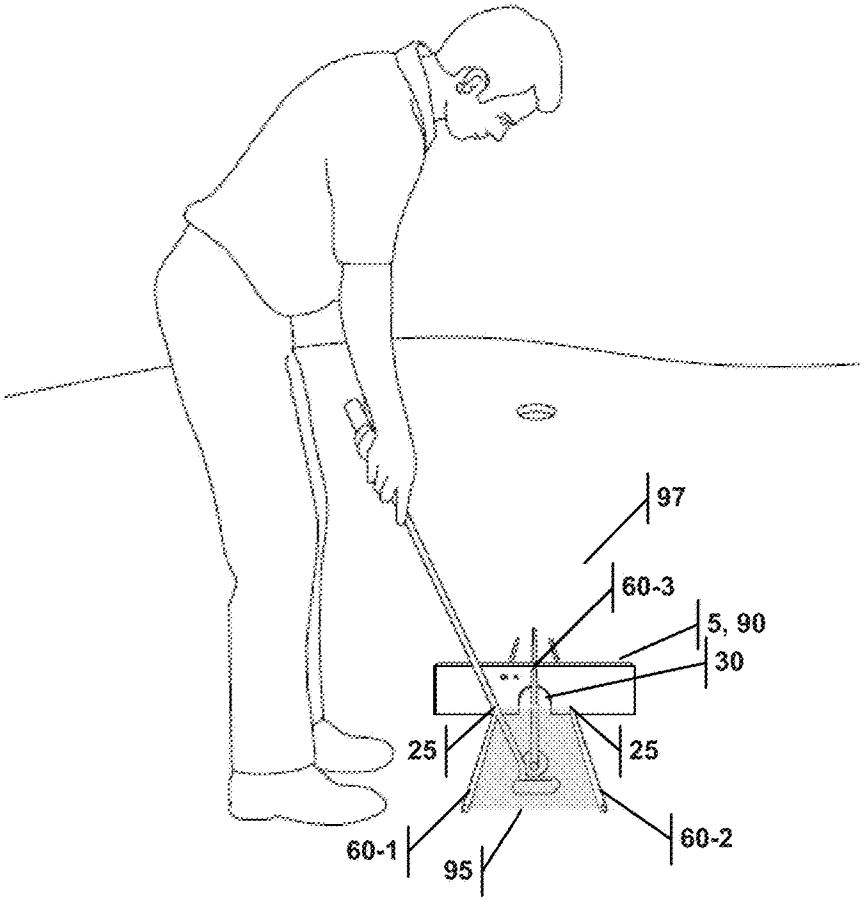
FIG. 18A is similar to FIG. 17A, except that the third alignment stick is position over the entire length of the putting hitting box.

FIGS. 17A-18B all show the golf training aid 5 in the putting configuration 97, whereby the elongate member 7 is in the upright position 90. Instead of having the golf ball travel over the golf training aid 5 and over the target alignment stick 60-3 through the target alignment hole 20, as in the previous hitting configurations, in the putting configuration 97 the golf ball 75 instead passes through the putting hole pass through 30 and under the target alignment stick 60-3 provided. In FIG. 17B, the third alignment stick or target alignment stick 60-3 is positioned a distance of at least the diameter of the golf ball 75 so as to not impede the motion of the golf ball 75 in the putting configuration 97. In FIG. 18B, the alignment stick 60-3 is extended over the entire putting hit box 95 to better guide putting the golf ball 75 to the optimal putting ball travel path 105, provided the golf training aid 5 is correctly aligned toward the golf hole or pin 100.

What is now disclosed is a method for golf training, comprising the following steps: (a) providing a golf training aid 5 with an elongate member 7 with a longitudinal axis 8, the elongate member 7 itself comprising: (1) a first set of two holes 10, each constructed to receive an alignment stick (60-1, 60-2), the first set of holes spaced apart from each other; and (2) a target alignment hole 20 constructed to receive an alignment stick 60-3, the target alignment hole 20 being positioned in between the first set of holes 10; (b) inserting a first and second alignment sticks (60-1, 60-2) into the first set of holes 10 such that the first and second alignment sticks (60-1, 60-2) extend orthogonally from the longitudinal axis 8 and define a hitting box 70; (c) inserting a third alignment stick 60-3 into the target alignment hole 20 such that the third alignment stick 60-3 extends orthogonally from the longitudinal axis 8; (d) aligning the third alignment stick 60-3 with the target 100; (e) positioning a golf ball 75 within the hitting box 70; and (f) swinging a golf club to strike the golf ball 75 such that the golf ball 75 travels of the third alignment stick 60-3. Additionally, the method may further comprise, wherein the golf training aid 5 comprises a swing angle hole (40 or 50) constructed to receive an alignment stick 60-4: (g) before swinging the golf club, inserting a fourth alignment stick 60-4 into the swing angle hole (40 or 50) such that the fourth alignment stick 60-4 (1) extends away from the elongate member 7 in a direction that is orthogonal to the first alignment stick 60-1 and (2) defines a swing plane (43 or 48) that is at a swing angle (42 or 47) with the longitudinal axis 8, wherein the swing angle (42 or 47) is in the range of 40-60 degrees; and (h) maintaining the golf club parallel to the swing plane (either 43 or 48) for at least a portion of the swing. The portion of the swing where the golf club should be maintained parallel to the swing plane can be prior to the ball strike, or can be after the front swing.

Another golf training method may comprise these following steps: (a) providing a golf training aid 5 with an elongate member 7 with a longitudinal axis 8, the elongate member 7 comprising: (1) a putting hole 30 constructed to allow a golf ball 75 to pass there through; (2) a set of two holes 25 each constructed to receive an alignment stick 60-1, 60-2; and (3) a putting target alignment hole 35 constructed to receive an alignment stick 60-3, the putting target alignment hole 35 positioned above the putting hole 30 and in between the set of holes 25; (b) inserting a first and second alignment sticks 60-1, 60-2 into the first set of holes 25 such that the first and second alignment sticks 60-1, 60-2 extend orthogonally from the longitudinal axis 8, defining a putting box 95; (c) inserting a third alignment stick 60-3 into the putting target alignment hole 35 such that the third alignment stick 60-3 extends orthogonally from the longitudinal axis 8; (d) aligning the third alignment stick 60-3 with the target 100; (e) positioning the golf ball 75 within the putting box 95; and (f) striking the golf ball 75 such that it travels under the third alignment stick 60-3 and through the putting hole 30. For this training method, the golf ball 75 can be stuck with a putter having a putter head, and during the ball strike, the putter head can also travel under the third alignment stick 60-3.

Although the term wood has been used in this disclosure, it would be understood that the only difference between a wood swing setup and a driver swing setup is the golf tee used with the driver setup, with the driver swing plane and the wood swing plane essentially one and the same and the driver swing angle and wood swing angle substantially the same. Therefore, the same configuration of the golf training aid disclosed herein for the wood swing also aids the driver swing, and one may consider the terms wood swing and driver swing to be interchangeable in the context of the configuration and use of the golf training aid of the present invention.

The invention has been described in connection with specific embodiments that illustrate examples of the invention but do not limit its scope. Various example systems have been shown and described having various aspects and elements. Unless indicated otherwise, any feature, aspect or element of any of these systems may be removed from, added to, combined with or modified by any other feature, aspect or element of any of the systems. As will be apparent to persons skilled in the art, modifications and adaptations to the above-described systems and methods can be made without departing from the spirit and scope of the invention, which is defined only by the following claims. Moreover, the applicant expressly does not intend that the following claims "and the embodiments in the specification to be strictly coextensive." Phillips v. *AHW Corp.,* 415 F.3d 1303, 1323 (Fed. Cir. 2005) (en banc).

The invention claimed is:

1. A golf training aid comprising:

an elongate member formed in a plank shape defined, at least in part, by:

a main face extending, in a main plane, longitudinally in a length direction of the elongate member, a first side extending in the length direction of the elongate member and along a first edge of the main face, the first side being orthogonal to the main plane, a second side extending in the length direction of the elongate member and along a second edge of the main face opposite the first edge, and a width direction of the elongate member being a direction oriented orthogonally through both the first side and the second side, a rear face extending in a rear plane in the length direction of the elongate member, the rear face being spaced apart from and parallel to the main face, and a thickness direction of the elongate member being a direction oriented orthogonally through both the main face and the rear face, a putting hole extending completely through the elongate member in the thickness direction, and partially through the elongate member in the width direction, the putting hole being positioned at the second side of the elongate member such that the second side of the elongate member has a gap along the length direction, and the putting hole being sized to allow a golf ball to pass therethrough, a first hole extending completely through the first side and the second side of the elongate member in the width direction, the first hole being aligned with a line of symmetry of the putting hole, a second hole extending completely through the main face and the rear face of the elongate member in the thickness direction, the second hole being aligned with the line of symmetry of the putting hole and positioned adjacent the first side of the elongate member, thereby intersecting the first hole perpendicularly, a pair of third holes extending completely through the main face and the rear face of the elongate member in the thickness direction, the pair of third holes being oppositely spaced from the line of symmetry of the putting hole and passing partially through the second side of the elongate member thereby forming respective openings, and a pair of fourth holes extending completely through the first side and the second side of the elongate member in the width direction, respectively intersecting the pair of third holes at the respective openings, such that the pair of fourth holes extends perpendicularly to the pair of third holes;

a first alignment stick;

a second alignment stick; and a third alignment stick, wherein, in:

a vertical position, in which the rear face extends perpendicular to a horizontal surface, the second hole accommodates the third alignment stick therein such that the third alignment stick is suspended linearly above the putting hole and extends out from the main face and the rear face, and the pair of third holes respectively, accommodate the first alignment stick and the second alignment stick therethrough such that the first alignment stick and the second alignment stick extend out from the main face and the rear face, whereby the first alignment stick and the second alignment stick are trapped, in the width direction, in the pair of third holes, respectively, against the horizontal surface due to engagement with respective inner perimeters of the pair of third holes at the respective openings at the second side of the elongate member, and a horizontal position, in which the rear face extends parallel to the horizontal surface, the first hole accommodates the third alignment stick therethrough so as to extend through the putting hole beyond the second side of the elongate member and beyond the first side of the elongate member.

2. The golf training aid according to claim 1, wherein:

the first hole is a target alignment hole, and the elongate member further includes one or more angle holes that extend through the main face across the thickness direction of the elongate member, an angle of the one or more angle holes being non-orthogonal to the main face of the elongate member.

3. The golf training aid according to claim 2, wherein the angle of the one or more angle holes is a swing plane angle ranging from 50-60 degrees with respect to an axis extending in the length direction.

4. The golf training aid according to claim 2, wherein the one or more angle holes includes an iron swing angle hole that is angled through the elongate member such that the angle formed with respect to the main face ranges from 50-60 degrees.

5. The golf training aid according to claim 4, wherein the angle of the iron swing angle hole is 56 degrees.

6. The golf training aid according to claim 2, wherein the one or more angle holes includes an iron swing angle hole and a wood swing angle hole, and wherein, the iron swing angle hole is located a first distance from a centerline that is colinear with the target alignment hole, and the wood swing angle hole is located at a second distance from the centerline that is colinear with the target alignment hole, the second distance being greater than the first distance.

7. The golf training aid according to claim 2, wherein the one or more angle holes includes a wood swing angle hole that is angled through the elongate member such that the angle formed with respect to the main face ranges from 40-50 degrees.

8. The golf training aid according to claim 7, wherein the angle of the wood swing angle hole is 48 degrees.

9. A golf training aid comprising:

an elongate member having a main face opposite a rear face, the main face and the rear face sharing a length dimension and a width dimension, the length dimension being greater than the width dimension, a thickness dimension being determined as a distance between the main face and the rear face, and a first side opposite a second side, the first side and the second side sharing the length dimension and the thickness dimension, the elongate member including:

a putting hole sized to allow passage of a golf ball through the main face of the elongate member, the putting hole being positioned such that:

when the elongate member is placed on a surface in a vertical position, the main face is oriented vertically with respect to the surface such that the golf ball is passable through the putting hole along the surface, an upper edge of the putting hole being bounded by the elongate member in a direction of the width dimension, and a lower edge of the putting hole being bounded by the surface, and when the elongate member is placed on the surface in a horizontal position, the main face is oriented horizontally with respect to the surface such that the rear face of the elongate member is against the surface and the putting hole is inaccessible such that the golf ball does not pass therethrough, a first alignment hole extending completely through the elongate member in the direction of the width dimension, the first alignment hole being aligned with a line of symmetry of the putting hole, a second alignment hole extending completely through the main face and the rear face of the elongate member in a direction of the thickness dimension, the second alignment hole being aligned with the line of symmetry of the putting hole and positioned to intersect the first alignment hole, a first pair of holes to indicate a putting box, the first pair of holes being disposed symmetrically on opposite sides of, and at a first distance away from, the line of symmetry of the putting hole, and the first pair of holes extending through the elongate member in the direction of the thickness dimension and being partially open through the first side of the elongate member, a second pair of holes to indicate a wide hitting box, the second pair of holes being disposed symmetrically on opposite sides of, and at a second distance away from, the line of symmetry of the putting hole, the second distance being greater than the first distance, and the second pair of holes extending through the elongate member in the direction of the width dimension, and a third pair of holes extending completely through the first side and the second side of the elongate member in the direction of the width dimension, respectively intersecting the first pair of holes, such that the third pair of holes extends perpendicularly to the first pair of holes;

a first alignment stick; and a pair of second alignment sticks, wherein, in the horizontal position:

the first alignment hole accommodates the first alignment stick therethrough so as to extend through the putting hole in the elongate member in the direction of the width dimension and beyond the first side of the elongate member and beyond the second side of the elongate member, and the pair of second alignment sticks are accommodated within the second pair of holes to extend parallel to each other from opposite ends of the elongated member.

10. The golf training aid according to claim 9, wherein the elongate member is a parallelepiped.

11. The golf training aid according to claim 9, wherein the second alignment hole is a putting target alignment hole, the putting target alignment hole being sized to receive the first alignment stick therein to pass completely therethrough.

12. The golf training aid according to claim 11, wherein the first alignment hole is a swing target alignment hole.

13. The golf training aid according to claim 9, wherein, when in the vertical position:

the second alignment hole accomodates the first alignment stick therethrough so as to extend through the elongate member in the direction of the thickness dimension so as to extend beyond the main face and the rear face, and the first pair of holes accommodate the pair of second alignment sticks, respectively, to extend parallel to each other from opposite sides of the putting hole.

14. A golf training aid comprising:

an elongate member formed in a plank shape defined, at least in part, by:

a main face extending, in a main plane, longitudinally in a length direction of the elongate member, a first side extending in the length direction of the elongate member and along a first edge of the main face, the first side being orthogonal to the main plane, a second side extending in the length direction of the elongate member and along a second edge of the main face opposite the first edge, and a width direction of the elongate member being a direction oriented orthogonally through both the first side and the second side, a rear face extending in a rear plane in the length direction of the elongate member, the rear face being spaced apart from and parallel to the main face, and a thickness direction of the elongate member being a direction oriented orthogonally through both the main face and the rear face, a putting hole extending completely through the elongate member in the thickness direction, and partially through the elongate member in the width direction, the putting hole being positioned at the second side of the elongate member such that the second side of the elongate member has a gap along the length direction, and the putting hole being sized to allow a golf ball to pass therethrough, a first hole extending completely through the first side and the second side of the elongate member in the width direction, the first hole being aligned with a line of symmetry of the putting hole, a second hole extending completely through the main face and the rear face of the elongate member in the thickness direction, the second hole being aligned with the line of symmetry of the putting hole and positioned adjacent the first side of the elongate member, thereby intersecting the first hole, a pair of third holes extending completely through the main face and the rear face of the elongate member in the thickness direction, the pair of third holes being oppositely spaced from the line of symmetry of the putting hole and partially open through the second side of the elongate member, and a pair of fourth holes extending completely through the first side and the second side of the elongate member in the width direction, respectively intersecting the pair of third holes, such that the pair of fourth holes extends perpendicularly to the pair of third holes.

15. The golf training aid according to claim 14, further comprising one or more angle holes that extend through the main face across the thickness direction of the elongate member with an angle of incidence being non-orthogonal with respect to the main face of the elongate member.

16. The golf training aid according to claim 14, further comprising a pair of fifth holes extending completely through the first side and the second side of the elongate member in the width direction, the pair of fifth holes being symmetrically spaced further apart than the pair of third holes from the putting hole.

* * * * *